US006360631B1

(12) United States Patent
Wortmann et al.

(10) Patent No.: US 6,360,631 B1
(45) Date of Patent: Mar. 26, 2002

(54) ELECTRONIC THROTTLE CONTROL ACCELERATOR PEDAL MECHANISM WITH MECHANICAL HYSTERESIS PROVIDER

(75) Inventors: Martin Wortmann, Clarkston; Srini Sundaresan, Rochester Hills, both of MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 0 days.

(21) Appl. No.: 09/481,649

(22) Filed: Jan. 12, 2000

(51) Int. Cl.[7] ..... G05G 1/14
(52) U.S. Cl. ..... 74/513; 74/560; 267/209
(58) Field of Search ..... 74/512, 513, 514, 74/560; 267/205, 209, 212, 213

(56) References Cited

U.S. PATENT DOCUMENTS

| | | | | | |
|---|---|---|---|---|---|
| 1,700,643 | A | * | 1/1929 | Nordell | 74/513 |
| 1,747,083 | A | * | 2/1930 | Ries | 74/513 |
| 2,001,415 | A | * | 5/1935 | Freeman | 74/513 |
| 2,166,128 | A | * | 7/1939 | Castle | 74/513 |
| 2,207,435 | A | * | 7/1940 | Jones | 74/513 |
| 2,245,852 | A | * | 6/1941 | Castle | 74/513 |
| 2,312,031 | A | * | 2/1943 | Coutcher | 74/513 |
| 2,335,847 | A | * | 12/1943 | Dath | 267/209 |
| 2,390,205 | A | * | 12/1945 | Dath | 267/209 |
| 2,470,172 | A | * | 5/1949 | Leese | 267/212 |
| 2,479,672 | A | * | 8/1949 | Dath | 267/212 |
| 2,527,177 | A | * | 10/1950 | Dach | 74/513 |
| 2,551,204 | A | * | 5/1951 | Christenson | 267/212 |
| 2,565,671 | A | * | 8/1951 | Withall | 267/213 |
| 2,565,672 | A | * | 8/1951 | Withall | 267/213 |
| 2,572,453 | A | * | 10/1951 | Dentler | 267/209 |
| 2,822,902 | A | * | 2/1958 | Glick | 74/513 |
| 3,128,859 | A | * | 4/1964 | Griffen | 74/513 |
| 4,574,757 | A | * | 3/1986 | Schulman et al. | 74/513 |
| 4,869,220 | A | | 9/1989 | Imoehl | |
| 4,944,269 | A | | 7/1990 | Imoehl | |
| 4,958,607 | A | | 9/1990 | Lundberg | |
| 5,133,225 | A | | 7/1992 | Lundberg et al. | |
| 5,385,068 | A | | 1/1995 | White et al. | |
| 5,408,899 | A | | 4/1995 | Stewart | |
| 5,507,201 | A | | 4/1996 | Fairbairn et al. | |
| 5,529,296 | A | * | 6/1996 | Kato et al. | 74/513 |
| 5,563,355 | A | * | 10/1996 | Pluta et al. | 74/514 |
| 5,697,260 | A | | 12/1997 | Rixon et al. | |
| 5,868,040 | A | | 2/1999 | Papenhagen et al. | |
| 5,934,152 | A | * | 8/1999 | Aschoff et al. | 74/513 |
| 5,937,707 | A | | 8/1999 | Rixon et al. | |

FOREIGN PATENT DOCUMENTS

EP 0670235 B1 8/1997

* cited by examiner

*Primary Examiner*—David A. Bucci
*Assistant Examiner*—Chong H. Kim
(74) *Attorney, Agent, or Firm*—Porter, Wright, Morris & Arthur

(57) ABSTRACT

A control pedal assembly for a motor vehicle includes a support structure, a pedal arm pivotally mounted to the support structure and carrying a pedal, and a sensor for detecting rotation of the pedal arm and sending an electrical signal to a control device indicating the rotation of the pedal arm. The pedal assembly also includes a hysteresis device adapted to generate a desired feel in response to pivotal movement of the pedal arm. The hysteresis device is secured to the support structure and includes a plunger engaging the pedal arm and is movable within a chamber between an extended position and a depressed position upon rotation of the pedal arm. A pair of coaxial compression springs resiliently bias the plunger to the extended position. The chamber forms a first friction surface and the plunger has a plurality of prongs forming a second friction surface engagable with the first friction surface to resist pivotal movement of the pedal arm. Friction between the first and second friction surfaces, that is resistance to movement of the plunger, increases as the plunger moves from the extended position toward the depressed position. Variable friction is obtained because the prongs form angled surfaces engaging the spring for wedging the prongs in a radially outward direction to engage the first and second friction surfaces together with increasing, force as the springs are compressed.

15 Claims, 2 Drawing Sheets

ELECTRONIC THROTTLE CONTROL ACCELERATOR PEDAL MECHANISM WITH MECHANICAL HYSTERESIS PROVIDER

FIELD OF THE INVENTION

The present invention generally relates to a control pedal assembly for a motor vehicle and, more particularly, to a control pedal assembly for a motor vehicle which is electronically coupled and has a mechanical hysteresis device to simulate the feel of a control pedal assembly which is mechanically coupled.

BACKGROUND OF THE INVENTION

Control pedals are typically provided in a motor vehicle, such as an automobile, which are foot operated by the driver. Separate control pedals are provided for operating brakes and an engine throttle. When the motor vehicle has a manual transmission, a third control pedal is provided for operating a transmission clutch. The control pedals are typically connected to control devices by cables or other mechanical transmission devices which convert the limited rotary motion of the pedals into useful mechanical motion at the control devices to control operation of the motor vehicle. The engine throttle is typically connected to an accelerator pedal through a mechanical cable such as a Bowden cable. This mechanical linkage has a desirable and functional "feel" wherein the pressure required for advancing the control pedal to accelerate the motor vehicle is greater than the pressure required for maintaining the pedal in a fixed position to maintain the motor vehicle at a constant speed. This difference of required pressures is often referred to as a "hysteresis effect". The pressure required to advance the control pedal is typically relatively high. This is desirable to obtain adequate return pressure to return the pedal to the idle position in a desired amount of time when foot pressure is removed from the control pedal. The pressure required to advance the control pedal is easily provided when accelerating but would become uncomfortable over time to maintain a relatively constant speed. Therefore, the hysteresis effect is important in providing a reasonable force for maintaining the accelerator pedal in position to comfortably drive at a generally constant speed while providing an adequate return force for returning the control pedal to idle to decelerate the motor vehicle.

There have been attempts to introduce an electrical linkage between the control pedal and the control device. Typically, a position sensor converts the position of the control pedal into an electrical signal which is sent to the control device. This electrical linkage has far fewer routing limitations than the mechanical linkages. The control pedal, however, must be provided with a hysteresis device to obtain the "feel" of a control pedal having a mechanical linkage. Various proposals have been made to provide a control pedal with both an electrical linkage and a mechanical hysteresis device. While these proposed control pedals may adequately provide the "feel" of a control pedal with a mechanical linkage, they are relatively complex and expensive to produce. Additionally, the proposed control pedals require a relatively large amount of space. Accordingly, there is a need in the art for a control pedal assembly which is electronically coupled and has a mechanical hysteresis device, is relatively simple and inexpensive to produce, and is highly reliable in operation.

SUMMARY OF THE INVENTION

The present invention provides a control pedal assembly which overcomes at least some of the above-noted problems of the related art. According to the present invention, a control pedal assembly comprises a support structure, a pedal arm pivotally mounted to the support structure and carrying a pedal on a rearward side of the pedal arm, and a hysteresis device adapted to generate a desired feel in response to pivotal movement of the pedal arm. The hysteresis device is secured to either the support structure or the pedal arm and engages the other. The hysteresis device is located below a pivot axis of the pedal arm and is located at a forward side of the pedal arm opposite the pedal. Locating the hysteresis device in this manner reduces the packaging size of the pedal assembly.

According to another aspect of the present invention, a control pedal assembly comprises a support structure, a pedal arm pivotally mounted to the support structure and carrying a pedal, and a hysteresis device adapted to generate a desired feel in response to pivotal movement of the pedal arm. The hysteresis device includes a plunger movable within a chamber between an extended position and a depressed position upon rotation of the pedal arm and at least one spring member resiliently biasing the plunger to the extended position. Such a hysteresis device is relatively simple and inexpensive to produce and is highly reliable in operation.

According to yet another aspect of the present invention, a control pedal assembly comprises a support structure, a pedal arm pivotally mounted to the support structure and carrying a pedal, and a hysteresis device secured to the support structure. The hysteresis device comprises a plunger engaging the pedal arm and movable within a chamber between an extended position and a depressed position upon rotation of the pedal arm and at least one compression spring resiliently biasing the plunger to the extended position. The chamber forms a first friction surface and the plunger has a plurality of prongs forming a second friction surface engagable with the first friction surface to resist pivotal movement of the pedal arm. The prongs form angled surfaces engaging the spring to wedge the prongs in an outward direction to engage the first and second friction surfaces with increasing force upon compression of the spring.

From the foregoing disclosure and the following more detailed description of various preferred embodiments it will be apparent to those skilled in the art that the present invention provides a significant advance in the technology and art of control pedal assemblies. Particularly significant in this regard is the potential the invention affords for providing a high quality, feature-rich, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawing, wherein.

Figure 1:
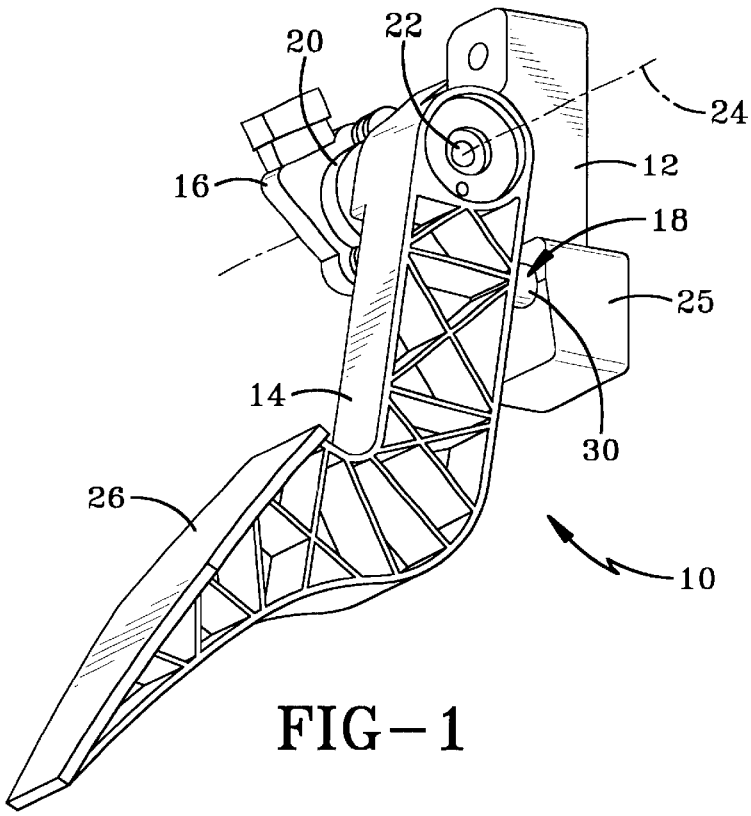
FIG. 1 is a perspective view of a control pedal assembly having a mechanical hysteresis device according to the present invention.

It should be understood that the appended drawings are not necessarily to scale, presenting a somewhat simplified representation of various preferred features illustrative of the basic principles of the invention. The specific design features of a control pedal assembly as disclosed herein, including, for example, specific dimensions of plunger will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the control pedal assembly illustrated in the drawings. In general, up or upward refers to an upward direction in the plane of the paper in FIG. 1 and down or downward refers to a down direction in the plane of the paper in FIG. 1. Also in general, fore or forward refers to a direction toward the front of the motor vehicle and aft or rearward refers to a direction toward the rear of the motor vehicle.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved control pedal assemblies disclosed herein. The following detailed discussion of various alternative and preferred embodiments will illustrate the general principles of the invention with reference to a control pedal assembly for use with a motor vehicle. Other embodiments suitable for other applications will be apparent to those skilled in the art given the benefit of this disclosure. The term "snap-fit connection" is used herein and in the claims to mean a connection between at least two components wherein one of the components has an opening and the other component has a protrusion extending into the opening, and either the protrusion or the opening has a resiliently deformable to allow insertion of the protrusion into the opening as the deformable portion deforms upon entry but to deny undesired withdrawal of the protrusion from the opening after the deformable portion resiliently snaps back such that the two components are secured together.

Figure 3:
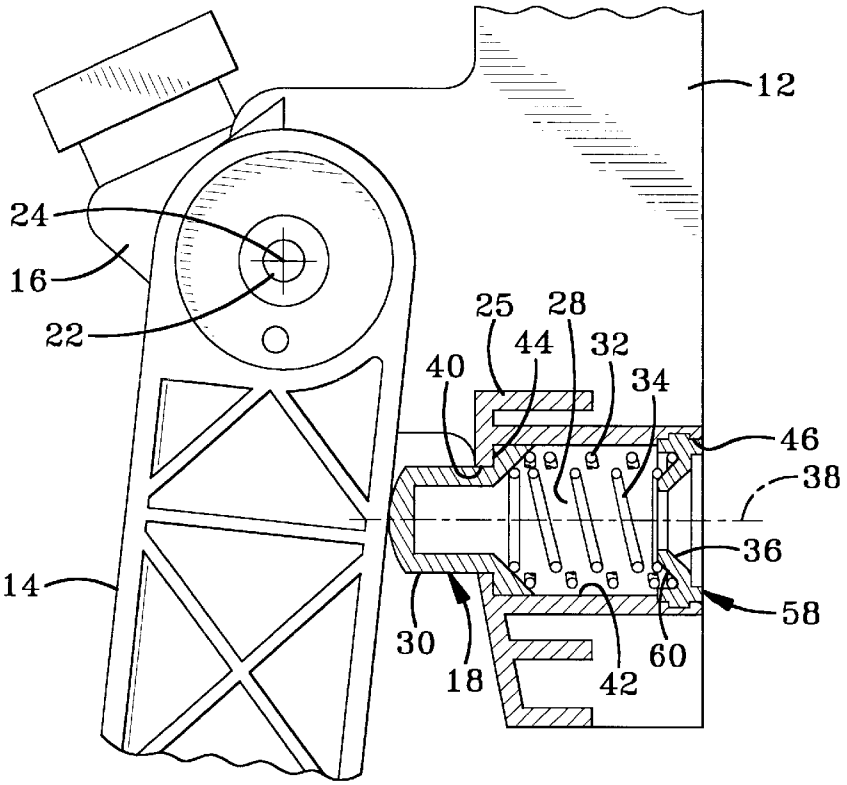
FIG. 3 is an enlarged, fragmented elevational view of the adjustable control pedal assembly similar to FIG. 2 but showing the mechanical hysteresis device in cross section.
Figure 2:
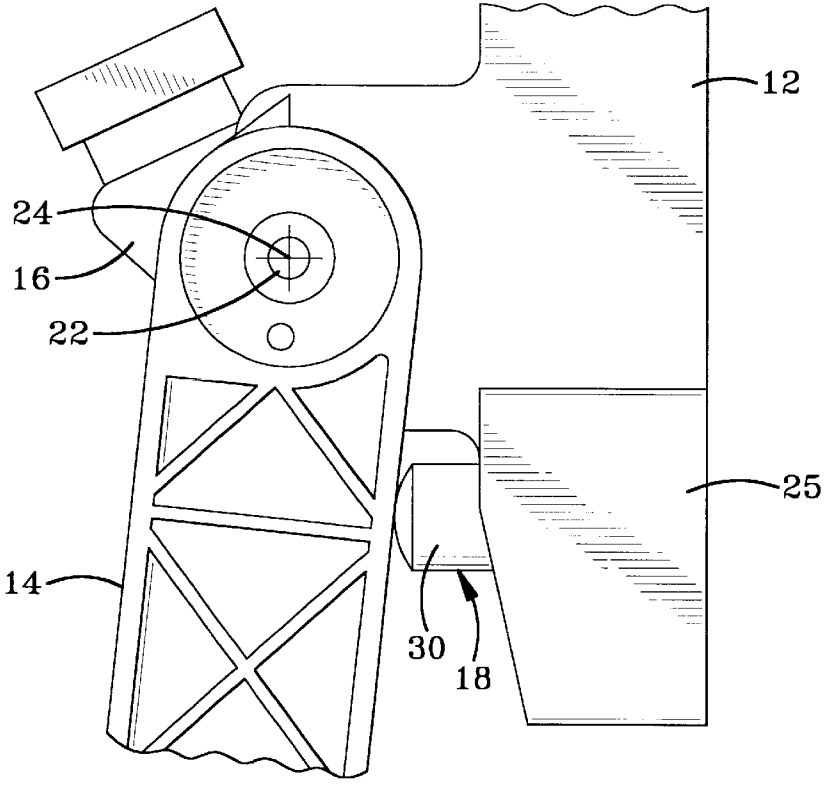
FIG. 2 is an enlarged, fragmented elevational view of the control pedal assembly of FIG. 1 showing the area of the mechanical hysteresis device.

Referring now to the drawings, FIGS. 1–3 show a control pedal assembly 10 for a motor vehicle, such as an automobile, according to the present invention which is selectively adjustable to a desired position by a driver. While the illustrated embodiments of the present invention are particularly adapted for use with an automobile, it is noted that the present invention can be utilized with any vehicle having a foot operated control pedal including trucks, buses, vans, recreational vehicles, earth moving equipment and the like, off road vehicles such as dune buggies and the like, air borne vehicles, and water borne vehicles. The control pedal assembly 10 includes a mounting bracket 12, a pedal arm 14 pivotally connected to the mounting bracket 12, a sensor 16 operatively connected to the pedal arm to provide electrical control signals regarding operation of the pedal arm 14 to a control device, and a mechanical hysteresis device 18.

The mounting bracket 12 is sized and shaped for rigid attachment of the adjustable control pedal assembly 10 to a firewall or other suitable support member of the motor vehicle. The mounting bracket 12 may be may be formed of ant suitable material such as, for example, a plastic like nylon and may be formed in any suitable manner such as, for example, molding. The mounting bracket 12 includes a rearwardly extending support 20 forming a laterally extending opening. The opening is sized and shaped for receiving a horizontally extending axle or pivot pin 22 which forms a horizontally and laterally extending pivot axis 24 for the pedal arm 14. The mounting bracket 12 also includes a lower portion 25 which is adapted to be located below the pivot axis 24 and forward of the pedal arm 14. The lower portion 25 of the mounting bracket 12 is adapted to support the mechanical hysteresis device 18 as described in more detail hereinafter.

The pedal arm 14 is sized and shaped for pivotal attachment to the mounting bracket 12. The pedal arm 14 may be may be formed of any suitable material such as, for example, plastic like nylon and may be formed in any suitable manner such as, for example, molding. The pedal arm 14 is generally elongate and has an upper end forming a laterally extending opening. The opening is sized and shaped for receiving the pivot pin 22 to pivotally secure the pedal arm 14 to the mounting bracket 12 for rotation about the pivot axis 24. The pivot pin 22 can be secured in any suitable manner. Attached to the mounting bracket 12 in this manner, the elongate pedal arm 14 hangs generally downward from the pivot pin 22. The pedal arm 14 has a lower end carrying a pedal 26. The pedal 26 of the illustrated embodiment is formed unitary with the pedal arm 14, that is, molded of a single piece.

The pedal arm 14 is operatively connected to the control device such as a throttle via the sensor 16 so that pivotal movement of the pedal arm 14 about the pivot axis 24 operates the control device in a desired manner. The illustrated sensor 16 is a rotational sensor adapted to sense rotation of the pedal arm 14. The sensor 16 secured to the mounting bracket 12 at the support opposite the pedal arm 14 where the pivot pin 22 extends to the sensor 16 for cooperation therewith. It is noted that the sensor 16 can be any suitable rotational sensor known to those skilled in the art. It is also noted that the sensor 16 can alternatively be a force sensor adapted to sense the amount of force applied to the pedal arm 14 or any other suitable type of sensor. The sensor 16 is in electrical communication, such as connected via wires, with the control device to provide electrical signals indicating rotational movement of the pedal arm 14.

As best shown in FIG. 3, the mechanical hysteresis device 18 includes a chamber 28 formed in the lower portion 25 of the mounting bracket 12, a plunger 30 axially movable within the chamber 28 between a fully extended position (shown in FIG. 3) and a fully depressed position, first and second spring members 32, 34 for resiliently biasing the plunger 30 to the fully extended position, and a retainer 36 for retaining the plunger 30 and the spring members 32, 34 within the chamber 28. The chamber 28 is formed by the lower portion 25 of the mounting bracket 12 and has a horizontal and forwardly extending central axis 38. The chamber 28 is located below the pivot axis 24, behind the pivot arm 14, and above the pedal 26. The chamber is preferably located near the pivot axis 24, that is, closer to the pivot axis 24 than to the pedal 26. The chamber 28 is sized and shaped for cooperation with the plunger 30 as described in more detail hereinafter. The illustrated chamber 28 is cylindrically shaped. The rearward end of the chamber 28 is provided with a first or rearward opening 40 having a diameter smaller than an inner wall 42 of the chamber 28 to form a forward facing abutment or stop 44 within the chamber 28. The forward end of the chamber 28 is provided with a second or forward opening 46 having a diameter substantially equal to the inner wall 42.

Figure 4A:
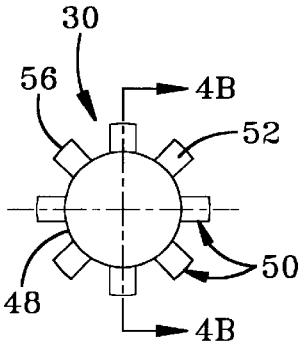
FIG. 4A is a rearward end view of a plunger of the mechanical hysteresis device of the pedal assembly of FIGS. 1–3.
Figure 4B:
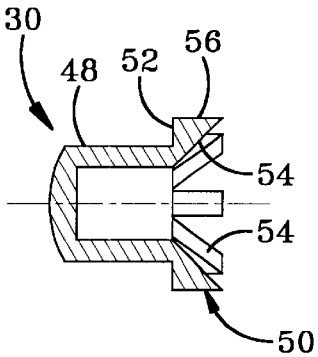
FIG. 4B is a cross sectional view of the plunger taken along line 4B—4B of FIG. 4A.
Figure 4C:
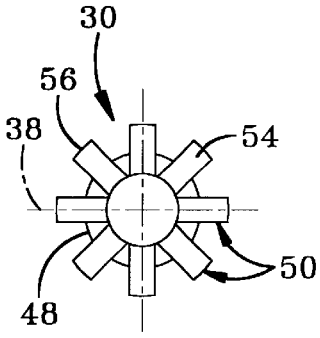
FIG. 4C is a forward end view of the plunger of FIGS. 4A and 4B.

As best shown in FIGS. 4A–4C, the plunger 30 has a generally hollow main body 48 and a plurality of radially extending and circumferentially spaced-apart fingers or prongs 50 at a forward end of the main body 48. The plunger 30 may be formed of any suitable material such as, for example, plastic and may be formed in any suitable manner such as, for example, molding. The main body 48 is sized and shaped to cooperate with the rearward opening 40 of the chamber 28. The main body 48 of the illustrated plunger 30 is generally cylindrical-shaped having a outer diameter sized for close cooperation with the rearward opening 40 of the chamber 28. The rearward end of the hollow main body 48 is preferably closed for engagement with the forward side of the pedal arm 14. The forward end of the hollow main body 48 is preferably open for formulation of the resilient prongs 50.

The prongs 50 radially extend from the forward end of the main body 48 and are circumferentially spaced apart along the periphery of the main body 48. The prongs 50 are preferably unitary with the main body 48, that is, formed of one-piece construction. The rearward end of each prong 50 preferably forms an abutment or stop 52 for cooperating with the stop 44 of the chamber 28 to limit rearward movement of the plunger 30. The forward end of each prong 50 is provided with an inclined or angled end surface 54 which forms an angle of less than 90 degrees to the central axis 38. The wedge-shaped end surfaces 54 of the prongs 50 collectively form a generally frusto-conically shaped seat for the rearward ends of the spring members 32, 34. The end surface 54 is adapted to cooperate with the spring members 32, 34 to provide a normal force (perpendicular to the central axis) on the prong 50 as described in more detail hereinafter. The end surface 54 preferably forms an angle in the range of about 30 degrees to about 70 degrees relative to the central axis 38 and more preferably forms an angle of about 45 degrees relative to the central axis 38. It should be appreciated that the greater the angle, the greater the wedging action of the prong 50 and resulting normal force and friction as discussed in more detail hereinbelow. The outer periphery of each prong 50 forms an engagement surface 56 adapted to frictionally engage the inner wall surface 42 of the chamber 28. The illustrated plunger 30 is provided with eight prongs 50 but it is noted that a greater or lesser number of prongs 50 can be utilized depending of the requirements of the particular hysteresis device 18.

As best shown in FIG. 3, the spring members 32, 34 are located within the chamber 28 and are adapted to resiliently bias the plunger 30 to the fully rearward or extended position (shown in FIG. 3). The illustrated first and second spring members 32, 34 are coaxial helical coil compression springs of differing coil diameters. It is noted, however, that spring members of other types can be utilized to urge or bias the plunger to the fully extended position. The rearward ends of the spring members 32, 34 engage the forward end of the plunger 30 at the end surfaces 54 of the prongs 50 and the forward ends of the spring members 32, 34 engage the retainer 36. It is noted that the mechanical hysteresis device 18 can operate with only one of the spring members 32, 34 but the other one of the second spring members 32, 34 is provided for redundancy as a protection against spring failure.

The retainer 36 located at the forward end of the chamber28 and is adapted to at least partially close the forward end of the chamber 28 and retain the plunger 30 and the first and second spring members 32, 34 within the chamber 28. The illustrated retainer 36 is a plug-like member which is adapted to cooperate with the lower portion 25 of the mounting bracket 12 to form a snap-in connection 58 to secure the retainer 36 to the mounting bracket 12. It is noted that the retainer 36 can take other forms such as, for example, a cap-like member. It is also noted that the retainer 36 can be secured to the mounting bracket 12 in other manners such as, for example, mechanical fasteners. The retainer 36 forms a seat 60 for the forward ends of the spring members 32, 34.

Installed in this manner, the rearward closed end of the plunger 30 engages the forward side of the pedal arm 14 near and below the pivot axis 24 to bias the pedal arm 14 to an idle position. When no pressure is applied to the pedal 26, the spring members 32, 34 urge the plunger 30 to the fully extended position which positions the pedal to an idle position (shown in FIG. 3). During operation of the motor vehicle, the operator depresses the pedal 26 using a foot to control the motor vehicle. The pressure on the pedal 26 pivots the pedal arm 14 about the pivot axis 24 against the bias of the spring members 32, 34. As the pedal arm 14 rotates, the sensor 16 detects the rotation and sends electrical signals indicating the rotation to the control device to control the motor vehicle. As the pedal arm 14 rotates, the pedal arm 14 actuates the plunger 30 forward into the chamber 28 against the bias of the spring members 32, 34. As the plunger 30 moves into the chamber 28, the prongs 50 are forced outward by the wedge action provided by the prong end surfaces 54 to force the prong engagement surfaces 56 against the inner wall of the chamber 28. It is noted that the wedge action of the end surfaces creates a force normal acting on the prongs 50. This engagement between the inner wall 42 and the prong engagement surfaces 56 with the normal force generates "friction" for the control pedal assembly 10. It is noted that the materials of the plunger 30 and the mounting bracket inner wall 42 are selected to obtain desired friction. Preferably, there is plastic to plastic contact to obtain the desired friction. As the pedal 26 is further depressed, the prongs 50 are engaged against the inner wall 42 with increasing normal force as the spring members 32, 34 are further compressed to generate "variable friction" for the control pedal assembly 10. It should be appreciated by one skilled in the art that differing requirements of the control pedal assembly 10 can be met by, for example, varying the angle of the prong end surfaces 54, the force provided by the spring members 32, 34, and/or the quantity and/or size of the prongs 50. When pressure is maintained on the pedal 26, the friction between the plunger 30 and the chamber inner wall 42 assists in maintaining the pedal arm 14 in position. Increased pressure is required on the pedal 26 to overcome the increasing friction and further advance the pedal 26. As the spring members 32, 43 are compressed, the prongs 50 are wedged in an outward direction with increasing force so that the hysteresis device 18 provides variable friction. When pressure is removed from the pedal 26, the spring members 32, 34 resiliently move the plunger 30 rearward to return the plunger 30 to the fully extended position. As the plunger 30 moves rearward, the plunger 30 pivots the pedal arm 14 about the pivot axis 24 to return the pedal 26 to the idle position wherein the plunger abutment 52 engages the chamber stop 44 and/or the pedal arm engages a separate mechanical stop.

From the above description, it should be appreciated that the present invention provides a control pedal assembly 10 which is relatively simple and inexpensive to produce and is highly reliable in operation. It should also be appreciated that the hysteresis device 18 is locate separate from the sensor 16 so that the hysteresis device 18 can be located in the most advantageous position such as, for example, a position to reduce package size of the control pedal assembly 10.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the control pedal assembly be an adjustable pedal assembly wherein a drive assembly selectively adjusts the disclosed control pedal assembly in a forward/rearward direction relative to the steering wheel/seat of the motor vehicle. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A control pedal assembly for electronically controlling an engine throttle comprising, in combination:

a support structure;

a pedal arm pivotally mounted to the support structure and carrying a pedal at a rearward side of the pedal arm;

an electronic throttle control including a sensor secured to the support structure and operatively connected to the pedal arm, the sensor providing electronic signals to the engine throttle responsive to movement of the pedal arm relative to the support structure;

a hysteresis device adapted to generate a desired feel in response to pivotal movement of the pedal arm, wherein the hysteresis device is secured to the support structure and engages the the pedal arm, the hysteresis device is located below a pivot axis of the pedal arm and the hysteresis device is located at a forward side of the pedal arm opposite the pedal;

wherein the hysteresis device includes a plunger movable within a chamber between an extended position and a depressed position upon rotation of the pedal arm, and at least one spring member resiliently biasing the plunger to the extended position;

wherein the chamber forms a first friction surface and the plunger forms a second friction surface engagable with the first friction surface to resist pivotal movement of the pedal arm; and wherein the plunger has a plurality of prongs forming the second friction surface.

2. The control pedal assembly according to claim 1, wherein the hysteresis device engages a forward side of the pedal arm opposite the pedal.

3. The control pedal assembly according to claim 1, wherein the hysteresis device is in sliding engagement with the pedal arm.

4. A control pedal assembly for electronically controlling an engine throttle comprising, in combination:

a support structure;

a pedal arm pivotally mounted to the support structure and carrying a pedal;

an electronic throttle control including a sensor secured to the support structure and operatively connected to the pedal arm, the sensor providing electronic signals to the engine throttle responsive to movement of the pedal arm relative to the support structure;

a hysteresis device adapted to generate a desired feel in response to pivotal movement of the pedal arm, wherein the hysteresis device comprises a plunger movable within a chamber between an extended position and a depressed position upon rotation of the pedal arm and at least one spring member resiliently biasing the plunger to the extended position;

wherein the chamber forms a first friction surface and the plunger forms a second friction surface engagable with the first friction surface to resist pivotal movement of the pedal arm; and wherein the plunger has a plurality of prongs forming the second friction surface.

5. The control pedal assembly according to claim 4, wherein hysteresis device is secured to the support structure and the plunger engages the pedal arm.

6. The control pedal assembly according to claim 5, wherein the hysteresis device is located below a pivot axis of the pedal arm.

7. The control pedal assembly according to claim 5, wherein the plunger engages a side of the pedal arm opposite the pedal.

8. The control pedal assembly according to claim 4, wherein the spring member is a compression spring.

9. The control pedal assembly according to claim 8, wherein there are two spring members and the spring members are coaxial compression springs.

10. The control pedal assembly according to claim 4, wherein the chamber is a cylinder.

11. The control pedal assembly according to claim 4, wherein the prongs are adapted to be deflected radially outward upon movement of the plunger toward the depressed position.

12. The control pedal assembly according to claim 11, wherein the spring member is a compression spring and the prongs form an angled surface engaging the spring member to wedge the prongs in an outward direction upon compression of the spring member.

13. A control pedal assembly for electronically controlling an engine throttle comprising, in combination:

a support structure;

a pedal arm pivotally mounted to the support structure and carrying a pedal;

an electronic throttle control including a sensor secured to the support structure at a pivot axis of the pedal arm and operatively connected to the pedal arm, the sensor providing electronic signals to the engine throttle responsive to movement of the pedal arm relative to the support structure; and a hysteresis device secured to the support structure and comprising a plunger engaging the pedal arm and movable within a chamber between an extended position and a depressed position upon rotation of the pedal arm and at least one compression spring resiliently biasing the plunger to the extended position, wherein the chamber forms a first friction surface and the plunger has a plurality of prongs forming a second friction surface engagable with the first friction surface to resist pivotal movement of the pedal arm, and the prongs form angled surfaces engaging the spring to wedge the prongs in an outward direction to engage the first and second friction surfaces with increasing force upon compression of the spring.

14. The control pedal assembly according to claim 1, wherein the sensor is located at a pivot axis of the pedal arm.

15. The control pedal assembly according to claim 4, wherein the sensor is located at a pivot axis of the pedal arm.

* * * * *